United States Patent [19]

Yoneda

[11] Patent Number: 4,530,672

[45] Date of Patent: Jul. 23, 1985

[54] SUMMERSAULTING TOY

[75] Inventor: Yosuke Yoneda, Tokyo, Japan

[73] Assignee: Tomy Kogyo Company, Incorporated, Japan

[21] Appl. No.: 602,611

[22] Filed: Apr. 20, 1984

[30] Foreign Application Priority Data

Jun. 24, 1983 [JP] Japan ..... 58-97801[U]

[51] Int. Cl.[3] ..... A63H 11/08

[52] U.S. Cl. ..... 446/324; 446/353

[58] Field of Search ..... 446/311, 312, 324, 330, 446/352, 353, 354, 355, 356

[56] References Cited

U.S. PATENT DOCUMENTS

| | | | |
|---|---|---|---|
| 895,186 | 8/1908 | Killman | 446/324 |
| 2,021,588 | 11/1935 | Baker | 446/324 |
| 2,698,498 | 1/1955 | Müller | 446/324 |
| 3,178,853 | 4/1965 | Greenwood et al. | 446/356 |
| 3,500,577 | 3/1970 | Bart | 446/324 |

*Primary Examiner*—Robert A. Hafer
*Assistant Examiner*—Daniel Nolan
*Attorney, Agent, or Firm*—K. H. Boswell

[57] ABSTRACT

A summersaulting toy has a housing with a motor located in the housing. A first and second shaft are located parallel to one another transverse to the longitudinal axis of the toy with the ends of the first and second shafts projecting beyond the right and left sides of the housing. A foot pedestal is attached to right and left sides of both the right and left shafts respectively. In response to rotation of the shafts by the motor, the housing rotates about the shafts such that the housing is rotated first by the foot pedestals on the first shaft as the housing summersaults up and over the first shaft, and then by the pedestals on the second shaft as the housing summersaults up and over the second shaft. This process repeats itself in a cyclic manner as the toy does summersaults across a support surface.

15 Claims, 6 Drawing Figures

SUMMERSAULTING TOY

BACKGROUND OF THE INVENTION

This invention is directed to a toy which is capable of moving in a summersault-like manner wherein the toy rotates first about a first shaft which is supported above a surface by pedestals on the end of the shaft, and then a second shaft which is also supported above a surface by pedestals on the end of the shaft.

Certain tumbling toys are known which utilize suction cups. Normally, the toy includes a front and back axle with a suction cup mounted to each of these axles. Located in conjunction with the suction cup is some sort of mechanism which will lift the end of the toy upward so as to break a seal between the suction cup and a support surface. These toys are operated by placing the toy on a vertical or very steeply slanted surface such that gravity tends to pull the toy downwardly. The toy will tumble over itself with it being held to the surface first by one suction cup and then the next.

The above described toys are interesting to play with for both children and adults because of their novel action. For these toys to operate properly however, they require a very smooth vertical or near vertical surface such as a window pane or the like. Because these toys have to be used with a very smooth vertical surface, this limits the play value of the toy.

For small children, it is not normally desirable to have these small children playing near a large window or glass door. An inherent danger resides in the child breaking the glass window or door and injuring or maiming themselves in the process.

Other types of toys are known which are capable of moving on horizontal surfaces. These toys skirt the disadvantages of playing on smooth vertical surfaces such as above. These toys however walk in a more normal manner, and not in the comic tumbling manner of the above referred to toys which will walk down a window pane or the like.

BRIEF DESCRIPTION OF THE INVENTION

In view of the above, it is considered that there exists a need for a toy which is capable of executing a tumbling or summersault-like motion across a horizontal support surface. It is therefore a broad object of this invention to fulfill this need. It is a further object of this invention to provide a toy which is simple in use yet interesting in action. It is a further object of this invention to provide a toy which, because of its construction and engineering, is susceptible to a long and useful lifetime, yet is economically available to the consuming public.

These and other objects, as will be evident from the remainder of this specification, are achieved in a walking toy which comprises: a housing; a motor located in said housing; a first shaft and a second shaft each rotatably mounted on said housing and positioned parallel to one another, each of said shafts having ends projecting beyond the left and right side of said housing; said first shaft being of a greater elongated dimension than said second shaft; connecting means operatively connecting each of said first and said second shafts to said motor whereby said motor rotates each of said shafts with respect to said housing in the same direction of rotation; pedestal means attaching to each of said ends of said first and said second shafts, said pedestal means of a size and shape so as to extend beyond said housing and support said housing above a support surface; in response to said rotation of said shafts with respect to said housing, said housing rotating in a summersault-like manner first about said first shaft with the pedestal means attaching to said first shaft supporting said housing and next about said second shaft with the pedestal means attaching to said second shaft supporting said housing.

Preferredly, the pedestal means on one of the first or second shafts on each of the right and the left sides of the toy would be further outboard from the side of the housing of the toy than the pedestal on the other of the shafts. In the illustrative embodiment, the first shaft is of a greater length than the second shaft and the pedestal means on the first shaft on both the right and left hand sides of the toy is further outboard than the pedestal means on the second shaft.

Further in the illustrative embodiments, each of the pedestal means includes a portion which extends toward the other shaft, that is, for the pedestal means on the first shaft, there will be a portion of the pedestal means on both the right and left hand sides of the toy which extends back toward the second shaft. Additionally, a further portion of the pedestal means can extend in the opposite direction, that is, extend away from the other shaft.

A gear train can be utilized to connect the motor to the shafts so as to rotate the shafts with an appropriate clutch interspaced in the gear train means such that inadvertent rotation of the shafts while the motor is fixed, or rotation of the motor while the shafts are fixed, will cause slippage at the clutch means so as to avoid damage to any of the components.

DETAILED DESCRIPTION OF THE DRAWINGS

This invention will be better understood when taken in conjunction with the drawings wherein.

This invention utilizes certain principles and/or concepts as are set forth in the claims which are appended to this specification. Those skilled in the toy arts will realize that these principles and/or concepts are capable of being illustrated in a variety of embodiments which may differ from the exact embodiment utilized for illustrative purposes herein. For this reason, this invention is not to be construed as being limited solely to the illustrative embodiment but is only to be construed in light of the claims.

DETAILED DESCRIPTION OF THE INVENTION

Figure 1:
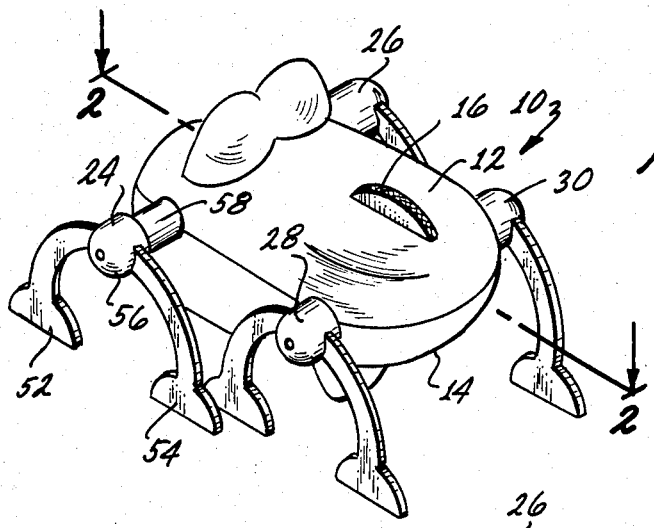
FIG. 1 is an isometric view of a toy embodying the principles of this invention.
Figure 5:
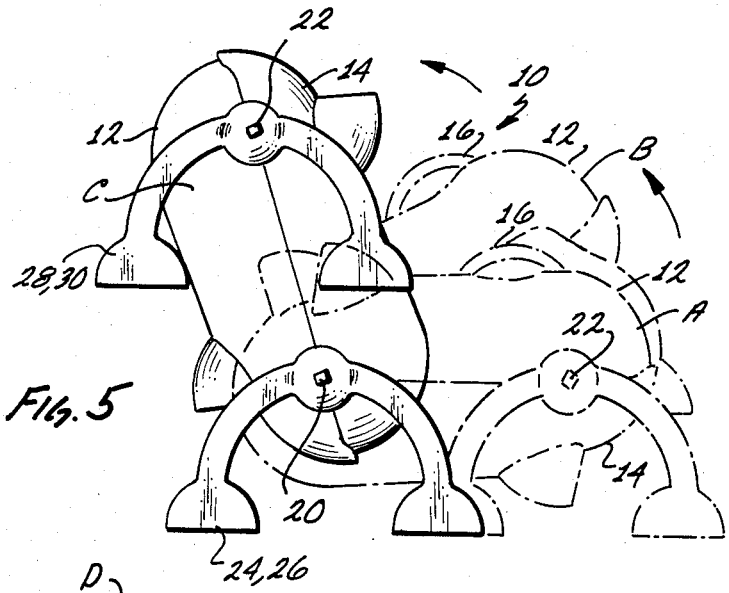
FIGS. 5 and 6 are elevational views showing sequential action of the toy of the invention between the respective views shown in solid and phantom lines in these figs.
Figure 6:
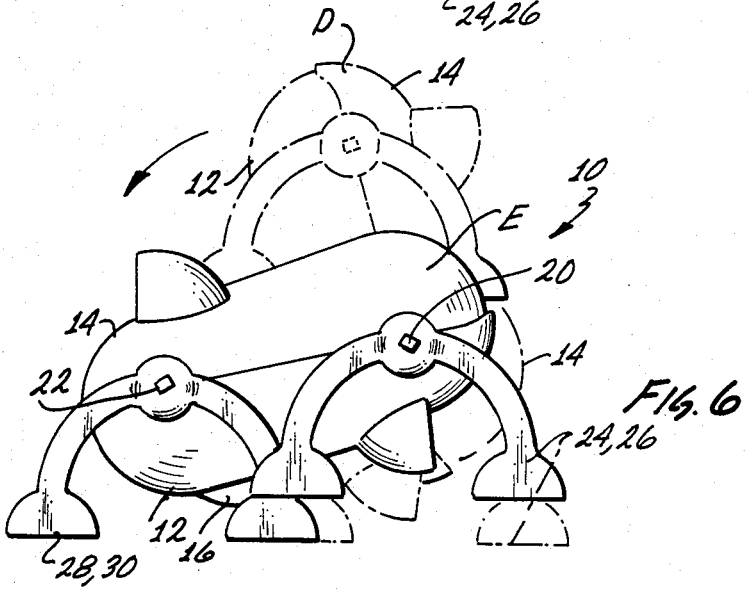

A toy 10 of this invention is shown in FIG. 1 in a rest state, and in FIGS. 5 and 6 in motion. The toy is shaped such that it really has no top or bottom, with a first housing shell 12 serving as the temporary top in FIG. 1 and a second housing shell 14 serving as the temporary bottom in FIG. 1, but with these housing shells 12 and 14 repositioned in other of the Figs. Extending out of the top of the shell 12 is a wind-up knob 16 which is rotated by a digit of the user to energize a motor 18 located within the toy 10.

A first shaft 20 is mounted between the shells 12 and 14 so as to be able to rotate with respect to them. A second shaft 22 is also so mounted. The shafts 20 and 22 are parallel with one another, and as will be evident below, rotate in unison with one another.

Located on both of the respective ends of the first and second shafts 20 and 22 are identical pedestal members 24 and 26 on shaft 20 and 28 and 30 on shaft 22. The pedestals, 24, 26, 28 and 30 are sized and shaped such that they hold the shells 12 and 14 upwardly above a support surface.

The motor shaft 32 extends out of the motor 18 and is rotated by the motor 18. The motor 18 is a common micro spring motor which is capable of rotating the motor shaft 32 in response to coiling of a spring located within the motor 18. A spur gear 34 is fixed to the motor shaft 32 with the spur gear 34 meshing with a second spur gear 36 which is formed as an integral unit with the wind up knob 16. Rotation of the wind-up knob 16 therefore causes rotation of the spur gear 36 which in turn rotates the gear 34 which in turn rotates the shaft 32 to wind up the motor 18.

A large spur gear 38 is located on the motor shaft 32. However it is not fixed to the motor shaft 32, and as such it rotates independent of the spur gear 34. The spur gear 38 includes a plurality of holes collectively identified by the numeral 40 located on its face. A bushing 42 is fixed to the motor shaft 32. The bushing 42 rotates in conjunction with the motor shaft 32 and the spur gear 34. The bushing 42 has two small arms collectively identified by the numeral 44 which project outwardly from the bushing and include small detents on the ends thereof which fit into the holes 40. The bushing 42 and the arms 44 are made of a spring-like plastic material such that the ends of the arms 44 where the detents are located are capable of flexing away from and toward the face of the large spur gear 38.

Figure 3:
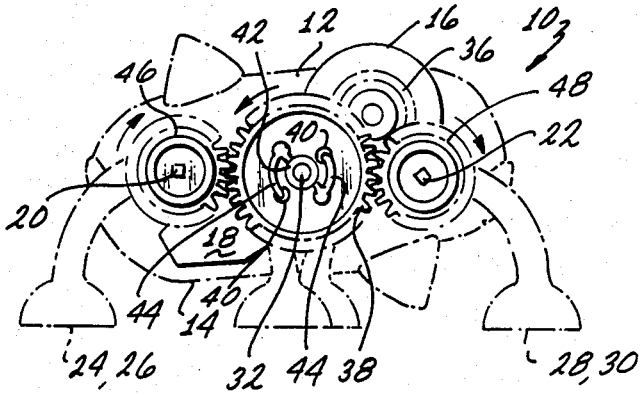
FIG. 3 is an elevational view about the line 3—3 of FIG. 2.

As viewed in FIG. 3, if the spur gear 38 is rotated clockwise, the detents on the ends of the arms 44 engage with the holes 40 to lock the bushing 42 to the spur gear 38. If the spur gear 38 was rotated counterclockwise in FIG. 3 and the bushing 42 as well as the shaft 32 to which it is fixedly attached was held fast, the arms 44 would slip with respect to the surface of the spur gear 38 with the detents on the ends of the arms 44 lifting free of the holes 40. Because of this, rotation would not be transferred between the spur gear 38 and the bushing 42. The interaction of the arms 44 in the holes 40 thus serves as a clutch means between the spur gear 38 and the motor shaft 32.

A spur gear 46 is fixedly mounted to the axle 20 and a spur gear 48 is fixedly mounted to the axle 22. Both of the spur gear 46 and 48 mesh with the spur gear 38 so as to transmit rotation between the spur gear 38 and the shafts 20 and 22. The arrangement of the spur gears 46 and 48 with respect to the spur gear 38 causes rotation of the spur gear 38 to be transmitted to the axles 20 and 22 to rotate them in the same direction. In FIG. 3, as the bushing 42 moves counterclockwise, its arms 44 engage with the holes 40 in the spur gear 38 to rotate it counterclockwise. The counterclockwise rotation of the spur gear 38 is transmitted to the spur gear 46 and 48 to rotate them clockwise.

Figure 4:
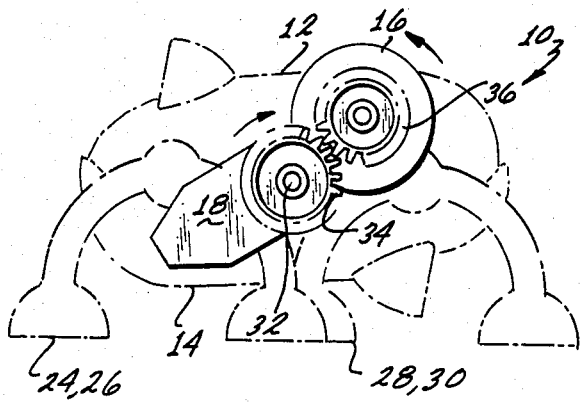
FIG. 4 is a view similar to FIG. 3 except that it is taken about the lines 4—4 of FIG. 2.

To activate the toy, the wind-up knob 16 is rotated counterclockwise as seen in FIG. 4 rotating the spur gear 34 and the motor shaft 32 clockwise. When the motor is activated, it then rotates the shaft 32 counterclockwise so as to ultimately produce a clockwise torque in the shafts 20 and 22. Because of the pedestal shapes of the members 24, 26, 28 and 30, these members will not rotate with respect to a support surface, and as such, the torque induced into the shafts 20 and 22 rotate the toy 10 about the shafts 20 and 22. As seen in FIG. 3, the counterclockwise torque input to the toy 10 by the shafts 20 and 22 rotates the toy 10 about the shaft 20.

Each of the pedestal members 24, 26, 28 and 30 include a front leg 52 and a rear leg 54. These are connected together at hub 56 which is integrally formed with a bushing 58. The bushing 58 for the pedestals 24 and 26 is longer than the equivalent bushing for the pedestals 28 and 30. Each of the bushings 58 includes a flange 60 which fits into an appropriate bearing surface formed between the shelves 12 and 14 so as to rotatably mount both the pedestals, such as pedestal 24 and 26, and the shaft, such as shaft 20, to the toy 10. In a like manner, the pedestals 28 and 30 and the shaft 22 would be rotatably mounted to the toy 10.

Figure 2:
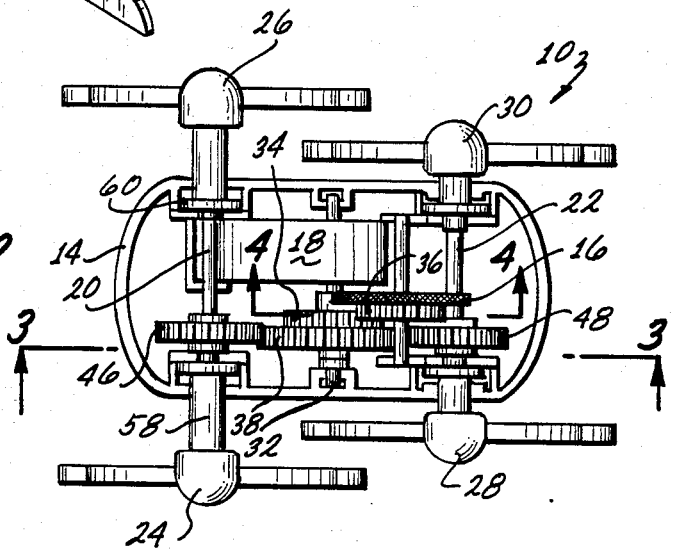
FIG. 2 is a plan view about the line 2—2 of FIG. 1.

Insofar as the bushings 58 on the pedestals 24 and 26 are longer than the bushings 58 on the pedestals 28 and 30, and the shaft 20 is longer than the shaft 22, the front and rear legs 52 and 54 of the pedestals 24 and 26 are further outboard with respect to the right and left hand sides of the toy 10 than are the same respective legs of the pedestals 28 and 30. On any one side of the toy 10, this allows positioning of the bottom part of rear leg 54 of a particular pedestal in line with the bottom part of the front leg 52 of the pedestal on the other axle. As, for instance, in FIGS. 1 and 2, the rear leg 54 of the pedestal 24 is positioned outboard of the front leg 56 of the pedestal 28. This overlap allows one or the other of the front or rear legs 52 or 54 to be moved ono the other side of a center line of the toy from the appropriate axle to which the pedestal is mounted. This provides for balancing of the toy 10 on either of the pedestals 24 and 26 about shaft 20, with the pedestals 28 and 30 on the shaft 22 lifted above the support surface, or vice versa, balancing on the pedestals 28 and 30 on the shaft 22 with the pedestals 24 and 26 on the shaft 20 lifted upwardly from a support surface.

In FIG. 5, the first phantom FIG. A shows the toy after the motor has been activated and the toy is ready to be released. Immediately upon releasing, the toy 10 rotates about the shaft 20 lifting the pedestals 28 and 30 upwardly from the support surface. It moves through the position B and up over the axle 20 until it is overcenter of the axle 20 to position C. Position C of FIG. 5 corresponds to Position D of FIG. 6. Further rotation from position D of FIG. 6 takes the toy back to Position A of FIG. 5, except the first housing shell is now on the bottom, and the second housing shell 14 is now on the top. Position E in FIG. 6 shows the toy 10 as it next moves, with rotation now being started around shaft 22 with the toy 10 being supported by pedestals 28 and 30 as pedestals 24 and 26 are lifted upwardly from the support surface. The toy 10 will undergo 180° revolution about shaft 22 and will then be repositioned with the shell 12 upwardly and the shell 14 downwardly, as per view A of FIG. 5.

The toy will move forward doing continuous summersaults, first about the shaft 20 and then about the shaft 22 until the spring in the motor 18 is unwound. It is evident that the toy 10 is capable of moving in a summersault or tumbling manner across a horizontal support surface by repeatedly executing the rotations alternately about the shafts 20 and 22.

I claim:

1. A walking toy which comprises:

a housing;

a motor located in said housing;

a first shaft and a second shaft each rotatably mounted on said housing and positioned parallel to one another, each of said shafts having ends projecting beyond the left and right sides of the housing;

connecting means connecting each of said first and said second shafts to said motor whereby said motor rotates each of said shafts with respect to said housing in the same constant direction of rotation;

first, second, third and fourth pedestal means, each of said respective pedestal means attaching to one of the respective ends of said first and said second shafts, said pedestal means of a size and shape so as to extend beyond said housing and support said housing above a support surface;

in response to said rotation of said shafts with respect to said housing, said housing rotating in a summersault like manner first about said first shaft with the pedestal means attaching to said first shaft supporting said housing and next about said second shaft with the pedestal means attaching to said second shaft supporting said housing.

2. The toy of claim 1 wherein:

said first shaft is of a greater length than said second shaft.

3. The toy of claim 2 wherein:

on each of the respective right and left sides of said toy the pedestal means on one of said first and said second shafts is positioned further away from the respective side of said toy than is the pedestal means on the other of said first or said second shafts on said same respective side of said toy.

4. The toy of claim 2 wherein:

said pedestal means on said first shaft on both the right and left sides of said toy is positioned further away from said respective sides of said toy than is the pedestal means on said second shaft on said respective side of said toy.

5. A walking toy which comprises:

a housing;

a motor located in said housing;

a first shaft and a second shaft each rotatably mounted on said housing and positioned parallel to one another, each of said shafts having ends projecting beyond the left and right sides of the housing;

connecting means connecting each of said first and said second shafts to said motor whereby said motor rotates each of said shafts with respect to said housing in the same direction of rotation;

pedestal means attaching to each of said ends of said first and said second shafts, said pedestal means of a size and shape so as to extend beyond said housing and support said housing above a support surface;

in response to said rotation of said shafts with respect to said housing, said housing rotating in a summersault like manner first about said first shaft with the pedestal means attaching to said first shaft supporting said housing and next about said second shaft with the pedestal means attaching to said second shaft supporting said housing;

on each of the respective right and left sides of said toy the pedestal means on one of said first and said second shafts is positioned further away from the respective side of said toy than is the pedestal means on the other of said first or said second shafts on said same respective side of said toy.

6. A walking toy which comprises:

a housing;

a motor located in said housing;

a first shaft and a second shaft each rotatably mounted on said housing and positioned parallel to one another, each of said shafts having ends projecting beyond the left and right sides of the housing;

connecting means connecting each of said first and said second shafts to said motor whereby said motor rotates each of said shafts with respect to said housing in the same direction of rotation;

pedestal means attaching to each of said ends of said first and said second shafts, said pedestal means of a size and shape so as to extend beyond said housing and support said housing above a support surface;

in response to said rotation of said shafts with respect to said housing, said housing rotating in a summersault like manner first about said first shaft with the pedestal means attaching to said first shaft supporting said housing and next about said second shaft with the pedestal means attaching to said second shaft supporting said housing;

each of said pedestal means includes a portion thereof which extends in a direction away from the one of said first and said second shafts on which said pedestal is located towards the other of said first and said second shafts.

7. The toy of claim 6 wherein:

each of said pedestals further include a further portion thereof which extends in a direction away from the one of said first and said second shafts on which said pedestal is located and also away from the other of said first and said second shafts.

8. The toy of claim 6 wherein:

said first shaft is of a greater length than said second shaft.

9. The toy of claim 8 wherein:

said pedestal means on said first shaft on both the right and left sides of said toy is positioned further away from said respective sides of said toy than is the pedestal means on said second shaft on said respective side of said toy.

10. The toy of claim 9 wherein:

each of said pedestals further include a further portion thereof which extends in a direction away from the one of said first and said second shafts on which said pedestal is located and also away from the other of said first and said second shafts.

11. The toy of claim 7 wherein:

each of said pedestal means includes a leading portion, a tailing portion and a connecting portion, said pedestal attaching to its respective shafts about said connecting portion with both said leading and said tailing portions in contact with said support surface.

12. A walking toy which comprises:

a housing;

a motor located in said housing;

a first shaft and a second shaft each rotatably mounted on said housing and positioned parallel to one another, each of said shafts having ends projecting beyond the left and right sides of the housing;

connecting means connecting each of said first and said second shafts to said motor whereby said motor rotates each of said shafts with respect to said housing in the same direction of rotation;

pedestal means attaching to each of said ends of said first and said second shafts, said pedestal means of a size and shape so as to extend beyond said housing and support said housing above a support surface;

in response to said rotation of said shafts with respect to said housing, said housing rotating in a summersault like manner first about said first shaft with the pedestal means attaching to said first shaft supporting said housing and next about said second shaft with the pedestal means attaching to said second shaft supporting said housing;

said connecting means including clutch means, said clutch means for transmitting rotation between said first and said second shafts and said motor in a first direction of rotation and inhibiting transfer of rotation between said first and said second shafts and said motor in the opposite direction of rotation.

13. The toy of claim 12 wherein:

said connecting means further includes gear train means connecting between said clutch means and said first and said second shafts.

14. The toy of claim 13 wherein:

each of said pedestals further include a further portion thereof which extends in a direction away from the one of said first and said second shafts on which said pedestal is located and also away from the other of said first and said second shafts.

15. The toy of claim 14 wherein:

each of said pedestal means includes a leading portion, a tailing portion and a connecting portion, said pedestal attaching to its respective shafts about said connecting portion with both said leading and said tailing portions in contact with said support surface.

* * * * *